US011435112B2

(12) United States Patent
Watanabe et al.

(10) Patent No.: US 11,435,112 B2
(45) Date of Patent: Sep. 6, 2022

(54) OUTDOOR UNIT OF AIR-CONDITIONING APPARATUS AND METHOD FOR MANUFACTURING THE SAME

(71) Applicant: Mitsubishi Electric Corporation, Tokyo (JP)

(72) Inventors: Takahiro Watanabe, Tokyo (JP); Kazuho Ito, Tokyo (JP); Hidetaka Yamauchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 249 days.

(21) Appl. No.: 16/635,294

(22) PCT Filed: Oct. 4, 2017

(86) PCT No.: PCT/JP2017/036122

§ 371 (c)(1),
(2) Date: Jan. 30, 2020

(87) PCT Pub. No.: WO2019/069392

PCT Pub. Date: Apr. 11, 2019

(65) Prior Publication Data

US 2020/0370784 A1 Nov. 26, 2020

(51) Int. Cl.
*F25D 21/14* (2006.01)
*F24F 13/22* (2006.01)
(Continued)

(52) U.S. Cl.
CPC ..... *F24F 13/222* (2013.01); *F24F 1/16* (2013.01); *F24F 1/56* (2013.01); *F24F 13/20* (2013.01); *F24F 13/30* (2013.01); *F24F 13/32* (2013.01)

(58) Field of Classification Search
CPC ..... F24F 13/222; F24F 13/20; F24F 13/30; F24F 13/32; F24F 1/16; F24F 1/56; F24F 1/22; F24F 1/36
(Continued)

(56) References Cited

U.S. PATENT DOCUMENTS

2014/0144167 A1* 5/2014 Yamauchi ..... F24F 13/222 62/259.1
2014/0165640 A1 6/2014 Takeuchi et al.

FOREIGN PATENT DOCUMENTS

JP 2000-328846 A 11/2000
JP 2005-236055 A 9/2005
(Continued)

OTHER PUBLICATIONS

Extended European Search Report dated Feb. 11, 2020 issued in corresponding EP patent application No. 17917892.6.
(Continued)

*Primary Examiner* — Len Tran
*Assistant Examiner* — Kamran Tavakoldavani
(74) *Attorney, Agent, or Firm* — Posz Law Group, PLC

(57) ABSTRACT

An outdoor unit of an air-conditioning apparatus includes: a bottom plate having a drain hole formed therein to discharge drain water generated in a heat exchanger; a heater provided at an upper surface of the bottom plate; a heater fixing tool provided to fix the heater to the bottom plate, with the heater interposed between the heater fixing tool and the upper surface of the bottom plate; a screw fastened after inserted into a screw hole from above to fix the heater fixing tool to the bottom plate, the screw hole being provided in overlapping portions of the heater fixing tool and the bottom plate; and a protective cap configured to cover a tip of the screw from below, which projects downwards from a lower surface of the bottom plate. The screw hole is located in a surrounding area which surrounds the drain hole, and the heater fixing tool is fixed to the bottom plate in the surrounding area.

4 Claims, 8 Drawing Sheets

(51) Int. Cl.

| | |
|---|---|
| ***F24F 1/16*** | (2011.01) |
| ***F24F 1/56*** | (2011.01) |
| ***F24F 13/20*** | (2006.01) |
| ***F24F 13/30*** | (2006.01) |
| ***F24F 13/32*** | (2006.01) |

(58) Field of Classification Search
USPC ..... 62/285
See application file for complete search history.

(56) References Cited

FOREIGN PATENT DOCUMENTS

| | | | |
|---|---|---|---|
| JP | 2010-071514 | A | 4/2010 |
| JP | 2010-091140 | A | 4/2010 |
| JP | 2014-105954 | A | 6/2014 |
| JP | 2014-119139 | A | 6/2014 |
| WO | 2011/027709 | A1 | 3/2011 |
| WO | 2017/056294 | A1 | 4/2017 |

OTHER PUBLICATIONS

International Search Report of the International Searching Authority dated Dec. 26, 2017 for the corresponding International application No. PCT/JP2017/036122 (and English translation).

* cited by examiner

OUTDOOR UNIT OF AIR-CONDITIONING APPARATUS AND METHOD FOR MANUFACTURING THE SAME

CROSS REFERENCE TO RELATED APPLICATION

This application is a U.S. national stage application of PCT/JP2017/036122 filed on Oct. 4, 2017, the contents of which are incorporated herein by reference.

TECHNICAL FIELD

The present invention relates to an outdoor unit of an air-conditioning apparatus and a method for manufacturing an outdoor unit of an air-conditioning apparatus, and more particularly, to protection of a tip of a screw for use in fixation of a heater.

BACKGROUND ART

In an outdoor unit of a conventional air-conditioning apparatus, a drain hole is formed in a central part of a bottom plate in a horizontal direction in order to discharge drain water generated by dew condensation in a heat exchanger during a heating operation. Also, in cold districts, a heater is attached to the bottom plate, since drain water on the bottom plate may freeze before discharged through the drain hole (see, for example, Patent Literature 1).

According to Patent Literature 1, part of a heater tube is pressed against an upper surface of the bottom plate by a heater fixing tool, and overlapping portions of the heater fixing tool and the bottom plate are fixed by screws, thereby attaching the heater to the bottom plate. The screws are each pressed into the header fixing tool and the bottom plate from the heater fixing device toward the bottom plate. A tip of each screw is projected downwards from the bottom plate. In order to ensure safety at the time of performing an attachment operation, the tip of the screw is covered with a leg portion fixed to a lower surface of the bottom plate, and is thus not exposed to the outside of the outdoor unit. To be more specific, a pair of leg portions are located at both end portions of the bottom plate in the horizontal direction, and one of the leg portions covers the tip of the screw.

CITATION LIST

Patent Literature

Patent Literature 1: Japanese Unexamined Patent Application Publication No. 2014-105954

SUMMARY OF INVENTION

Technical Problem

In the configuration described in Patent Literature 1, since the tip of a screw is covered with a leg portion, a fixing position of the screw is also set to an end portion of the bottom plate in the horizontal direction to conform to the position of the leg portion. By contrast, the drain hole is formed in a central part of the bottom plate in the horizontal direction, and the fixing position of the screw is thus located away from the drain hole. Therefore, the heater cannot be fastened to part of the bottom plate which surrounds the drain hole. Thus, at the part surrounding the drain hole, the heater is displaced or moved upwards. Inevitably, the heater cannot effectively heat the part surrounding the drain hole.

The present invention has been made in view of the above, and an object of the invention is to provide an outdoor unit of an air-conditioning apparatus, in which tips of screws can be protected, and at the same time a heater can be fixed to a surrounding area which surrounds a drain hole, and also a method for manufacturing the outdoor unit of the air-conditioning apparatus.

Solution to Problem

An outdoor unit of an air-conditioning apparatus, according to an embodiment of the present invention, includes a bottom plate having a drain hole formed therein to discharge drain water generated in a heat exchanger; a heater provided on an upper surface of the bottom plate; a heater fixing tool configured to fix the heater to the bottom plate, with the heater interposed between the heater fixing tool and the upper surface of the bottom plate; a screw fastened after inserted into a screw hole from above to fasten the heater fixing tool to the bottom plate, the screw hole being provided in overlapping portions of the heater fixing tool and the bottom plate; and a protective cap configured to cover a tip of the screw below, which projects downward from a lower surface of the bottom plate. The screw hole is located in a surrounding area which surrounds the drain hole, and the heater fixing tool is fixed to the bottom plate in the surrounding area.

Also, a method for manufacturing the outdoor unit of the air-conditioning apparatus, according to an embodiment of the present invention, includes providing a protective cap and a pair of leg portions at the bottom plate after turning over the bottom plate, the pair of leg portions being provided to support the outdoor unit; and joining the protective cap and the pair of leg portions to the bottom plate by caulking the protective cap and the pair of leg portions simultaneously.

Advantageous Effects of Invention

The embodiments of the present invention provide an outdoor unit of an air-conditioning apparatus, in which tips of screws can be protected, and at the same time a heater can be fixed to a surrounding area which surrounds a drain hole, and also a method for manufacturing the outdoor unit of the air-conditioning apparatus.

DESCRIPTION OF EMBODIMENTS

An air-conditioning apparatus according to the present invention will be described in detail below with reference to the accompanying drawings. It should be noted that in figures to be referred to below, there is a case where the relationship in size between components as illustrated is different from that between actual components. Also, in the figures, components which are the same as or equivalent to components previously referred to will be denoted by the same reference signs. The same is true of the entire text of the specification. Furthermore, the configurations of the components described in the entire text are explained by way of example, that is, they are not limited to the configurations described in the text.

Embodiment 1

Figure 1:
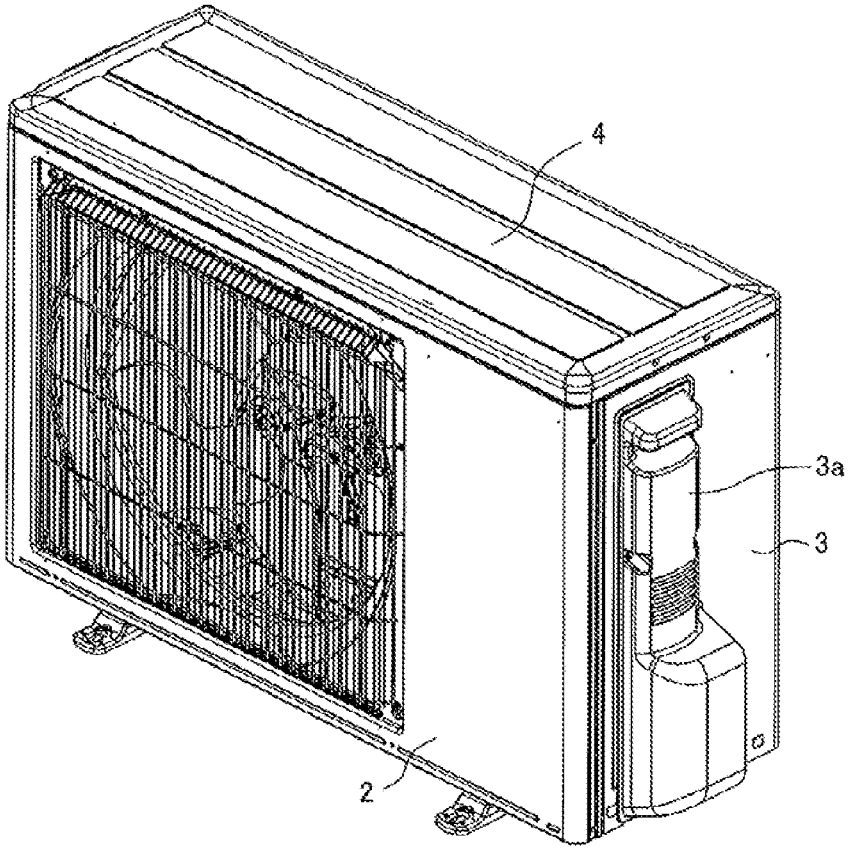
FIG. 1 is a perspective view illustrating an appearance of an outdoor unit of an air-conditioning apparatus according to embodiment 1 of the present invention.
Figure 2:
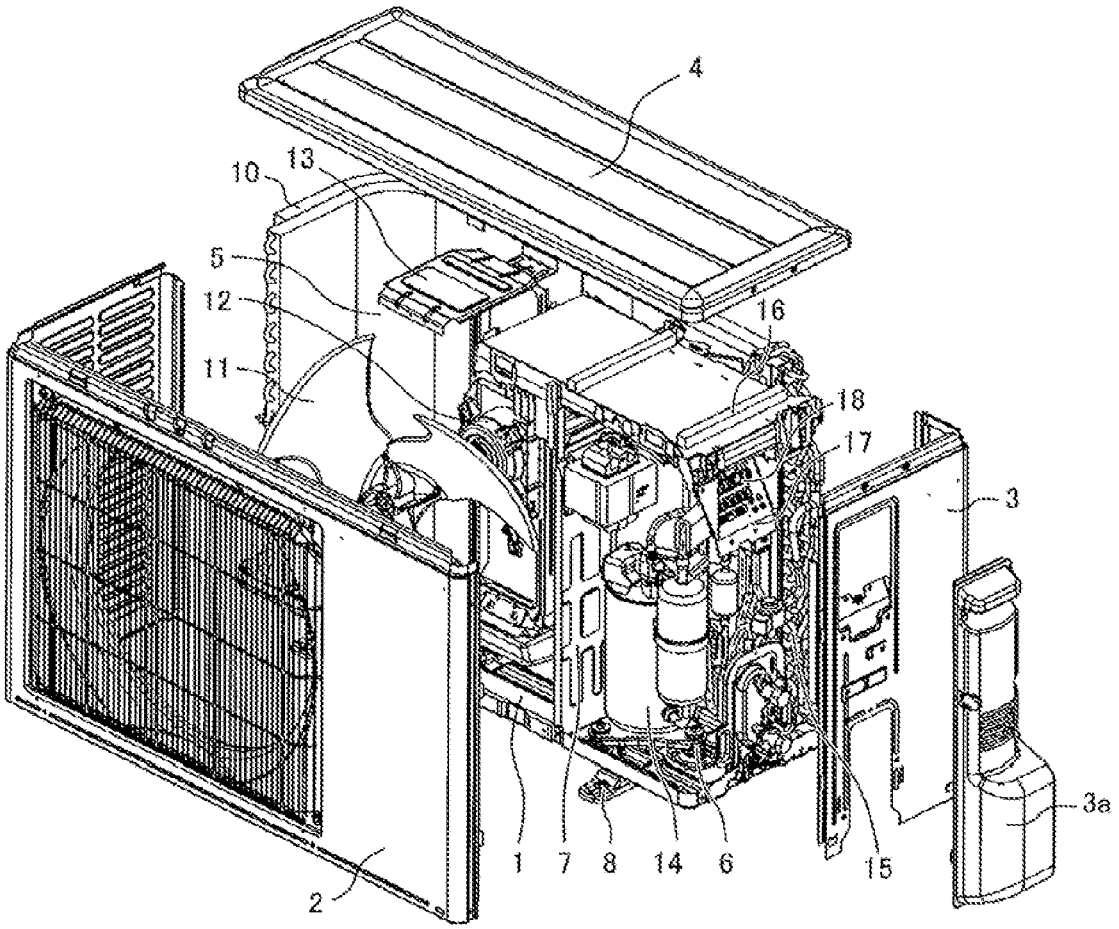
FIG. 2 is a perspective view illustrating the appearance and interior of the outdoor unit of the air-conditioning apparatus according to embodiment 1 of the present invention.

FIG. 1 is a perspective view illustrating an appearance of an outdoor unit of an air-conditioning apparatus according to embodiment 1 of the present invention. FIG. 2 is a perspective view illustrating the appearance and interior of the outdoor unit of the air-conditioning apparatus according to embodiment 1 of the present invention.

A casing of the outdoor unit of the air-conditioning apparatus includes a bottom plate 1, a front plate 2, a side plate 3, a protective cover 3*a* attached to the side plate 3, and a top plate 4. Components provided in the outdoor unit are held on an upper surface of the bottom plate 1. A pair of leg portions 8 are formed on a lower surface of the bottom plate 1, and support the outdoor unit. The inside of the casing is partitioned into a fan compartment 5 and a machine compartment 6 by a partition plate 7.

In the fan compartment 5, a heat exchanger 10 and a motor mount 13 are provided. The motor mount 13 is provided to hold a motor 12 including a propeller fan 11, in front of the heat exchanger 10.

In the machine compartment 6, a compressor 14, a refrigerant pipe 15 and an electrical component unit 16 are provided. Refrigerant sent from an indoor unit to the outdoor unit is compressed in the compressor 14, and is then sent to the heat exchanger 10 through the refrigerant pipe 15. Also, the electrical component unit 16 includes a control board, and is equipped with a power board 17 which, for example, supplies electric power to various components. A terminal block 18 for connection of the outdoor unit to the indoor unit (not illustrated) is fixed to the power board 17 by screws.

In the outdoor unit having the above configuration, when the propeller fan 11 is operated, air flows into the outdoor unit through the heat exchanger 10, then passes through the propeller fan 11, and flows out forwards from a front side of the outdoor unit. As a result, for example, during a cooling operation, refrigerant in the heat exchanger 10 is cooled by the air passing through the heat exchanger 10, that is, the air exchanges heat with the refrigerant, and is thus heated.

Figure 3:
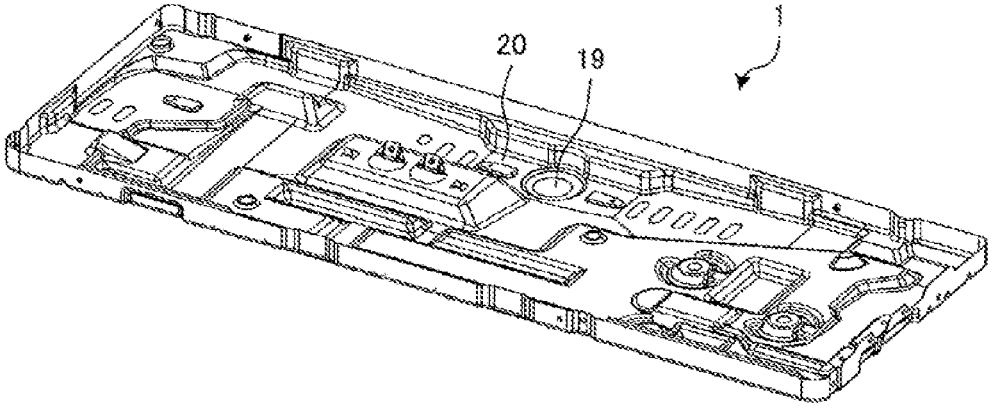
FIG. 3 is a perspective view of an upper surface of a bottom plate of the outdoor unit of the air-conditioning apparatus according to embodiment 1 of the present invention.
Figure 4:
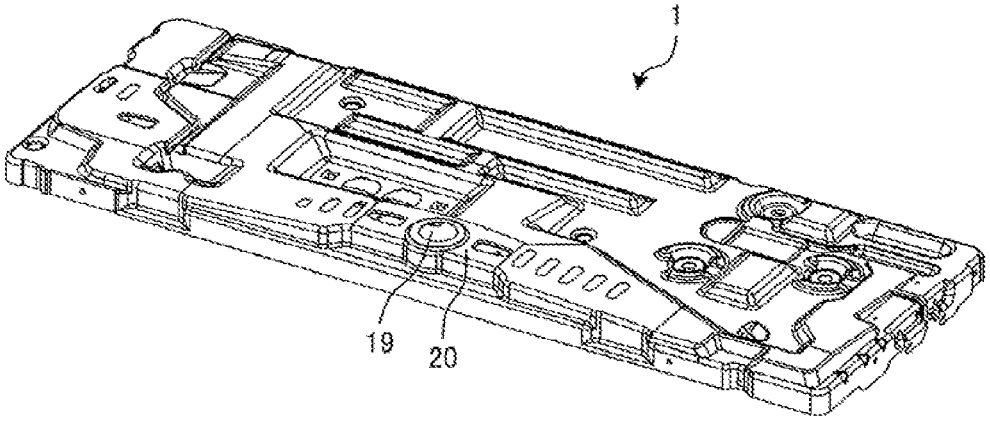
FIG. 4 is a perspective view of a lower surface of the bottom plate of the outdoor unit of the air-conditioning apparatus according to embodiment 1 of the present invention.
Figure 5:
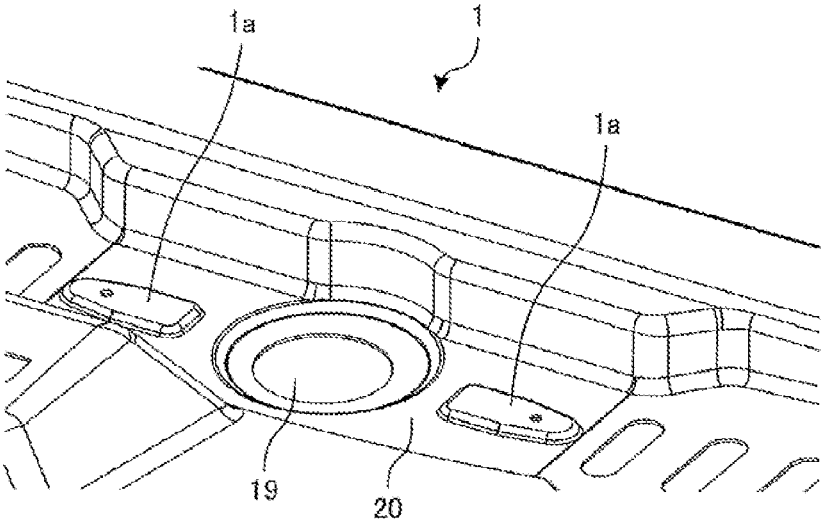
FIG. 5 is an enlarged view of a drain hole and a surrounding area which surrounds the drain hole as illustrated in FIG. 3.

FIG. 3 is a perspective view of the upper surface of the bottom plate of the outdoor unit of the air-conditioning apparatus according to embodiment 1 of the present invention. FIG. 4 is a perspective view of the lower surface of the bottom plate of the outdoor unit of the air-conditioning apparatus according to embodiment 1 of the present invention. FIG. 5 is an enlarged view of a drain hole and a surrounding area which surrounds the drain hole as illustrated in FIG. 3.

The bottom plate 1 has a flat portion 20 in central part thereof in a horizontal direction, and a drain hole 19 is formed in the flat portion 20. Drain water generated from dew condensation in the heat exchanger 10 during a heating operation flows down from the heat exchanger 10 to the bottom plate 1, and is then discharged to the outside of the outdoor unit through the drain hole 19.

Figure 6:
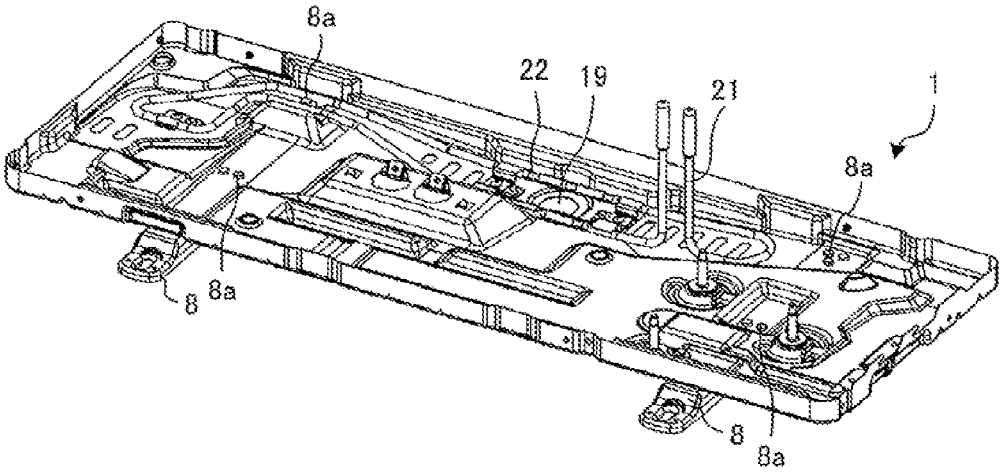
FIG. 6 is a perspective view of the upper surface of the bottom plate of the outdoor unit of the air-conditioning apparatus according to embodiment 1 of the present invention, with a heater mounted on the bottom plate.
Figure 7:
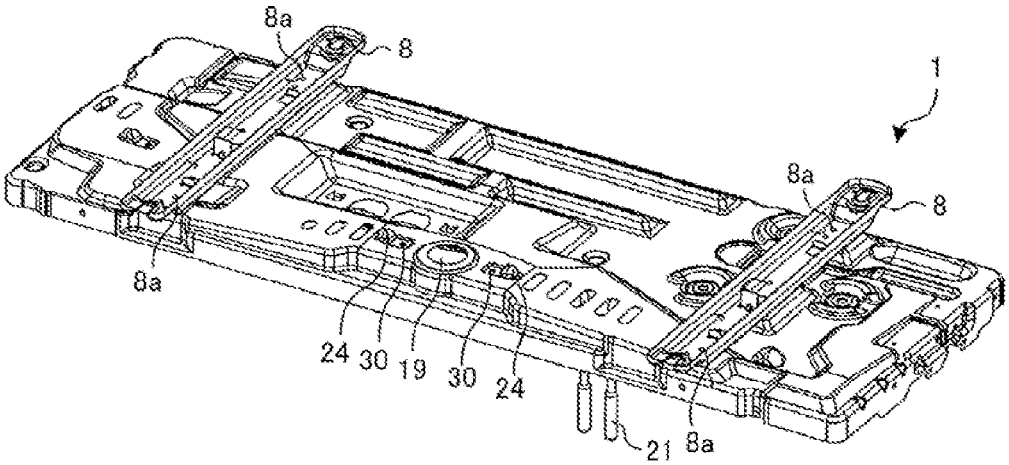
FIG. 7 is a perspective view of the lower surface of the outdoor unit of the air-conditioning apparatus according to embodiment 1 of the present invention, with the heater mounted on the bottom plate.
Figure 8:
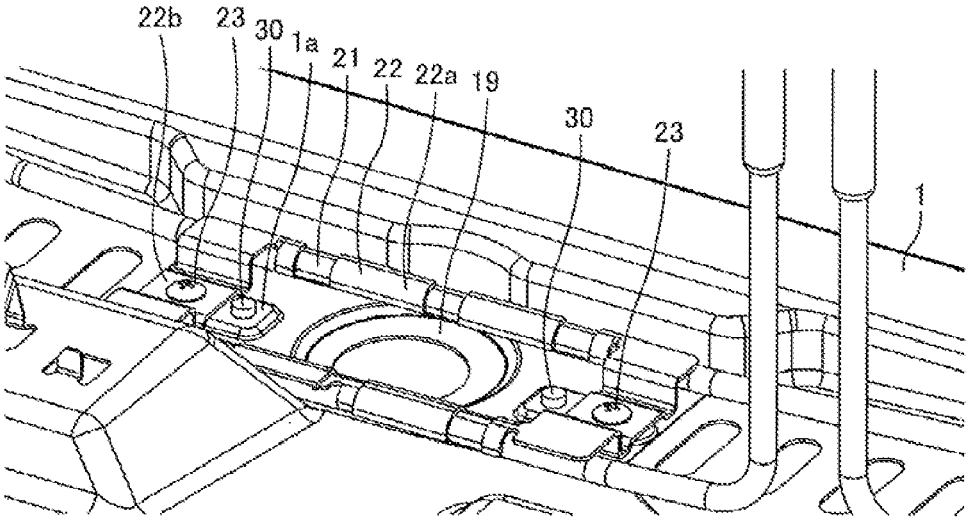
FIG. 8 is an enlarged view of the drain hole and the surrounding area as illustrated in FIG. 6.
Figure 9:
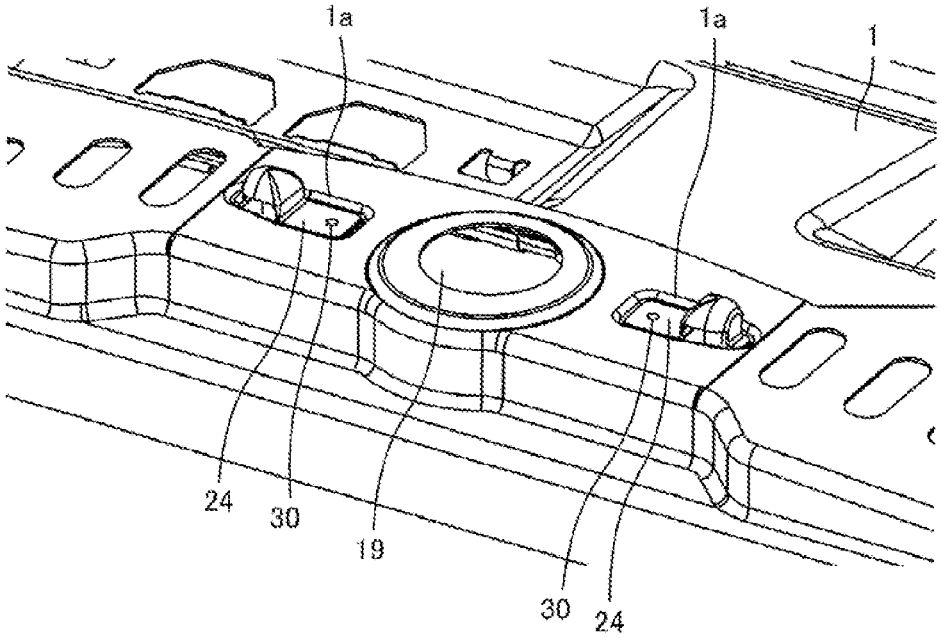
FIG. 9 is an enlarged view of the drain hole and the surrounding area as illustrated in FIG. 7.
Figure 10:
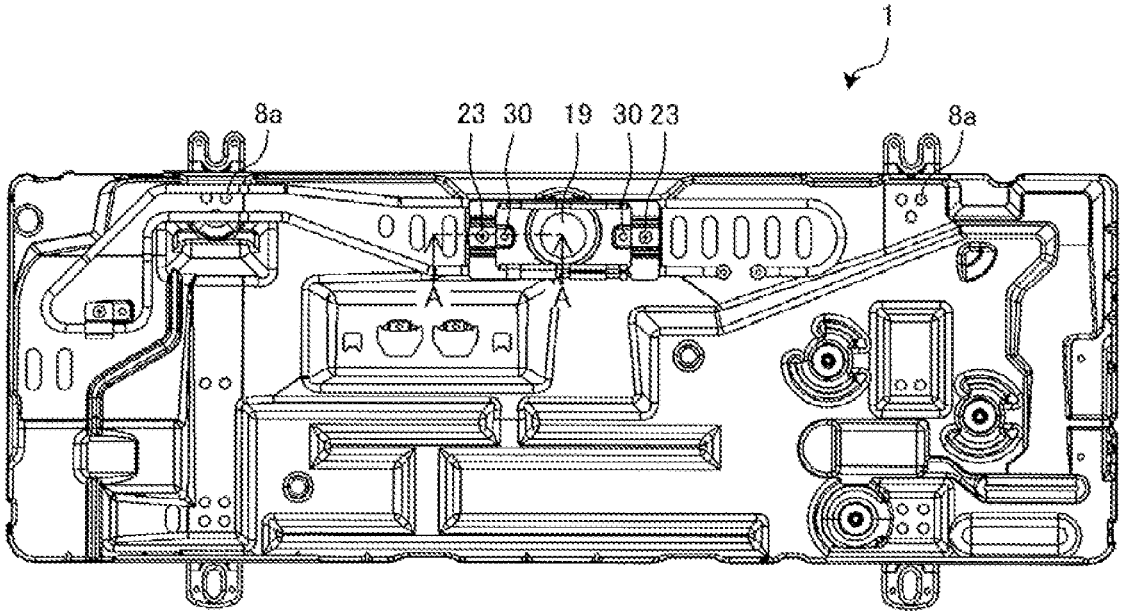
FIG. 10 is a plan view of the outdoor unit of the air-conditioning apparatus according to embodiment 1 of the present invention, with the heater mounted on the bottom plate.
Figure 11:
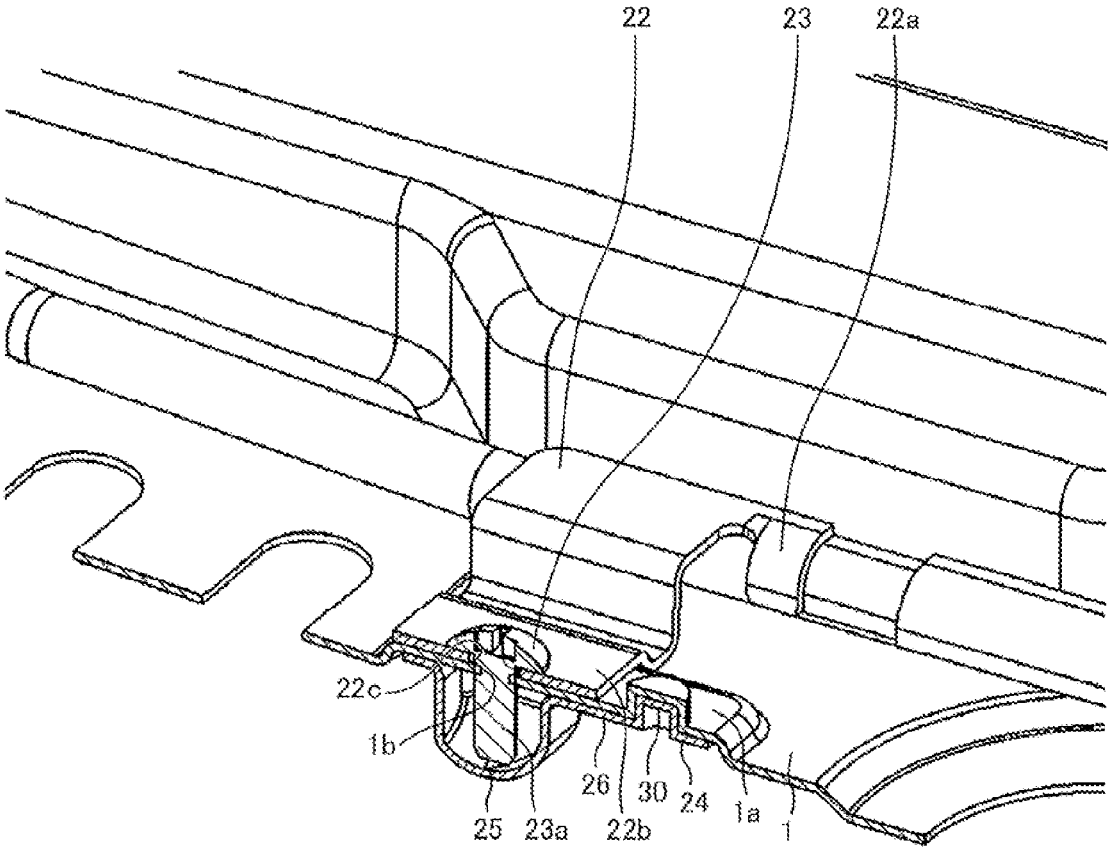
FIG. 11 is an enlarged sectional view taken along line A-A in FIG. 10.

FIG. 6 is a perspective view of the upper surface of the outdoor unit of the air-conditioning apparatus according to embodiment 1 of the present invention, with a heater mounted on the bottom plate. FIG. 7 is a perspective view of the lower surface of the bottom surface of the outdoor unit of the air-conditioning apparatus according to embodiment 1 of the present invention, with the heater mounted on the bottom plate. FIG. 8 is an enlarged view of the drain hole and the surrounding area as illustrated in FIG. 6. FIG. 9 is an enlarged view of the drain hole and the surrounding area as illustrated in FIG. 7. FIG. 10 is a plan view of the outdoor unit of the air-conditioning apparatus according to embodiment 1 of the present invention, with the heater mounted on the bottom plate. FIG. 11 is an enlarged sectional view taken along line A-A in FIG. 10.

On the bottom plate 1, a heater 21 is provided to prevent drain water from freezing. The heater 21 is fastened to the bottom plate 1 in the vicinity of the drain hole 19 by a heater fixing tool 22 and screws 23. To be more specific, the heater fixing tool 22 includes bent portions 22*a* which cover part of a tube of the heater 21 and attachment portions 22*b* having screw holes 22*c* (see FIG. 11) which are formed therein for insertion of the screws 23. In the bottom portion 1, raised portions 1*a* projecting upwards are provided in portions of the bottom plate 1 which overlap the attachment portions 22*b* of the heater fixing tool 22. The raised portions 1*a* are each shaped asymmetric in a single direction. For example, each of the raised portions 1*a* is bilaterally asymmetric in the horizontal direction, and one end of each raised portion 1*a* is tapered as illustrated in FIG. 9. In the raised portions 1*a*, screw holes 1*b* are formed in respective positons where they face the screw holes 22*c* in the heater fixing tool 22.

The heater fixing tool 22 having the above configuration is fastened to the bottom plate 1 by fastening the screws 23 after inserted into the screw holes 22*c* and the screw holes 1*b* in the raised portions 1*a* of the bottom plate 1. Tips 23*a* of the screws 23 are projected downward to a level lower than that of the bottom plate 1 as illustrated in FIG. 11, and are protected by respective protective caps 24 fixed to a lower surface of the raised portion 1*a*. The protective caps 24 will be described in detail later. In such a manner, the heater fixing tool 22 is fastened to the bottom plate 1, and thereby the tube of the heater 21 is pressed down by the bottom plate 1 from its top side, while held between the bottom plate 1 and the bent portions 22*a* of the heater fixing tool 22, to thereby prevent the tube from being moved upwards away from the bottom plate 1.

Figure 12:
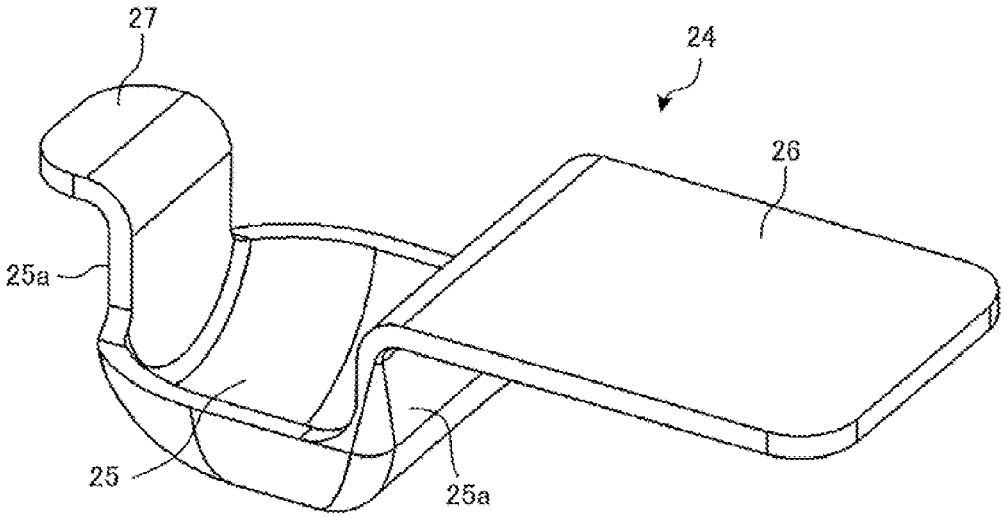
FIG. 12 is a perspective view of an upper surface of a protective cap to be provided at the bottom plate of the outdoor unit of the air-conditioning apparatus according to embodiment 1 of the present invention.
Figure 13:
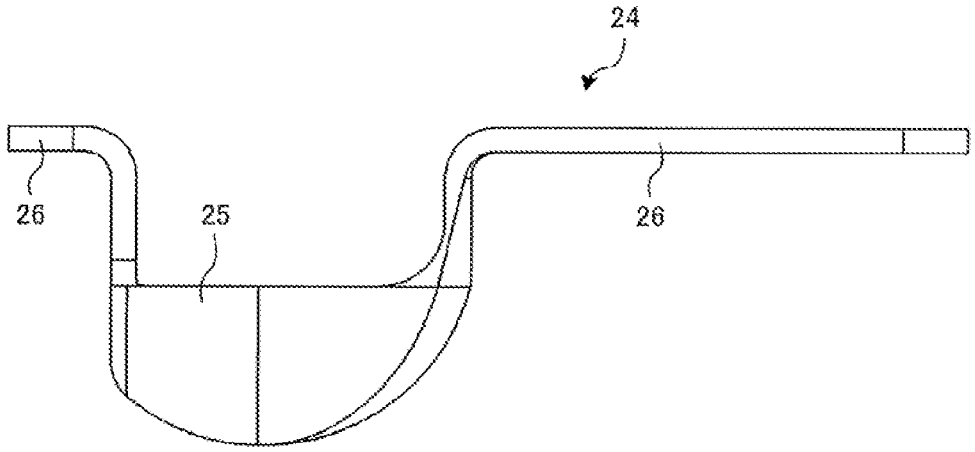
FIG. 13 is a front view of the protective cap to be provided at the bottom plate of the outdoor unit of the air-conditioning apparatus according to embodiment 1 of the present invention.

FIG. 12 is a perspective view of an upper surface of a protective cap to be provided on provided on the bottom plate of the outdoor unit of the air-conditioning apparatus according to embodiment 1 of the present invention. FIG. 13 is a front view illustrating the protective cap to be provided on the bottom plate of the outdoor unit of the air-conditioning apparatus according to embodiment 1 of the present invention.

The protective cap 24 includes a cover 25 which covers the tip 23*a* of the screw 23, a pair of extension portions 25*a* extending from opposite sides of an opening edge of the cover 25, and flange portions 26 and 27 which extend outwards from respective tips of the pair of extension portions 25*a*. The flange portions 26 and 27 are formed flush with each other. It should be noted that by omitting the extension portions 25*a*, the flange portions 26 and 27 may be formed to extend outwards directly from the opposite sides of the opening edge of the cover 25. The flange portions 26 and 27 correspond to a pair of flange portions of the present invention.

The flange portions 26 and 27 are formed to have different shapes, and are also shaped to conform to an outer shape of the raised portion 1*a*. Thereby, they are prevented from being mistakenly reversed when the protective cap 24 is fixed to the lower surface of the raised portion 1*a*.

In the case where the protective cap 24 having the above configuration is fixed to the bottom plate 1, the bottom plate 1 is turned over as illustrated in FIG. 9, and fixing of the protecting cap 24 is then carried out. When the bottom plate 1 is turned over, the raised portion 1*a* is also turned over to be in a recessed state as viewed from above, and the protective cap 24 is provided in the raised portion 1*a* being in the recessed state. The protective cap 24 is stably provided in the raised portion 1*a*, since the flange portions 26 and 27 of the protective cap 24 are formed flush with each other and a top surface of the raised portion 1*a* is also formed flat.

Then, the flange portion 26 of the protective cap 24 is joined to the raised portion 1*a* while caulking them using a device not shown. At this time, the pair of leg portions 8 are also simultaneously joined to the bottom plate 1 by caulking them. This joining using caulking is a joining method of locally pressing facing surfaces of two stacked objects with a punch, thereby mechanically joining the objects to each other. By the joining method using caulking, a caulked joint 30 (see FIG. 11) is formed at the flange portion 26 of the protective cap 24, thereby fixing the flange portion 26 to the bottom plate 1, and also, caulked joints 8*a* (see FIG. 6) are formed at the pair of leg portions 8, thereby fixing the leg portions 8 to the bottom plate 1.

As described above, in embodiment 1, since the tips 23*a* of the screws 23 for fastening the heater fixing tool 22 to the bottom plate 1 are protected by the protective caps 24, the fixing positions of the screws 23 can be freely set without the need to consider the positions of the leg portions. Therefore, the heater 21 can be fixed at an appropriate position in the surrounding area which surrounds the drain hole 19. Thus, this surrounding area can be heated by the heater 21. As a result, it is possible to prevent drain water from freezing in the vicinity of drain hole 19, and thus also preventing stopping of flowing of the water in the drain hole 19. That is, the drain hole 19 is not blocked up. It is therefore possible to provide an outdoor having a high reliability.

Furthermore, fixation of the protective cap 24 to the bottom plate 1 is carried out by the joining method using caulking, as well as fixation of the pair of leg portions 8 to the bottom plate 1. Therefore, the protective cap 24 and pair of leg portions 8 can be joined to the bottom plate 1 at the same time. Therefore, the manufacturing process can be simplified, as compared with a method in which joining of the protective cap 24 and joining of the pair of leg portions 8 are carried out in different processes.

REFERENCE SIGNS LIST bottom plate 1*a* raised portion 1*b* screw hole 2 front plate 3 side plate 3*a* protective cover 4 top plate 5 fan compartment 6 machine compartment 7 partition plate 8 leg portion 8*a* caulked joint 10 heat exchanger 11 propeller fan motor 13 motor mount 14 compressor 15 refrigerant pipe 16 electrical component unit 17 power board 18 terminal block 19 drain hole 20 flat portion 21 heater 22 heater fixing tool 22*a* bent portion 22*b* attachment portion 22*c* screw hole 23 screw 23*a* tip 24 protective cap 25 cover 25*a* a pair of extension portions 26 flange 27 flange 30 caulked joint

The invention claimed is:

1. An outdoor unit of an air-conditioning apparatus, comprising:

a bottom plate having a drain hole formed therein to discharge drain water generated in a heat exchanger;

a heater provided on an upper surface of the bottom plate;

a heater fixing tool configured to fix the heater to the bottom plate, with the heater interposed between the heater fixing tool and the upper surface of the bottom plate;

a screw fastened after inserted into a screw hole from above to fasten the heater fixing tool to the bottom plate, the screw hole being provided in overlapping portions of the heater fixing tool and the bottom plate; and a protective cap configured to cover a tip of the screw from below, which projects downwards from a lower surface of the bottom plate, wherein the screw hole is located in a surrounding area which surrounds the drain hole, and the heater fixing tool is fixed to the bottom plate in the surrounding area, the bottom plate has an upper surface at which a raised portion is formed, and the protective cap includes a cover portion configured to cover the tip of the screw and a pair of flange portions formed to extend from opposite sides of an opening edge of the cover portion, and at one of the pair of flange portions, a caulked joint is formed to fix the one of the pair of flange portions to the raised portion.

2. The outdoor unit of the air-conditioning apparatus of claim 1, wherein the bottom plate has a lower surface at which a pair of leg portions are formed to support the outdoor unit, and at the pair of leg portions, caulked joints are formed to fix the pair of leg portions to the bottom plate.

3. A method for manufacturing an outdoor unit of an air-conditioning apparatus which comprises: a bottom plate having a drain hole formed therein to discharge drain water generated in a heat exchanger; a heater provided on an upper surface of the bottom plate; a heater fixing tool configured to fix the heater to the bottom plate, with the heater interposed between the heater fixing tool and the upper surface of the bottom plate; a screw fastened after inserted into a screw hole from above to fasten the heater fixing tool to the bottom plate, the screw hole being provided in overlapping portions of the heater fixing tool and the bottom plate; and a protective cap configured to cover a tip of the screw from below, which projects downwards from a lower surface of the bottom plate, wherein the screw hole is located in a surrounding area which surrounds the drain hole, and the heater fixing tool is fixed to the bottom plate in the surrounding area, the method comprising:

providing the protective cap and a pair of leg portions at the bottom plate after turning over the bottom plate, the pair of leg portions being configured to support the outdoor unit; and joining the protective cap and the pair of leg portions to the bottom plate by caulking the protective cap and the pair of leg portions simultaneously.

4. The method for manufacturing the outdoor unit of the air-conditioning apparatus of claim 3, wherein: the bottom plate has an upper surface at which a raised portion is formed; and the protective cap includes a cover configured to cover a tip of the screw and a pair of flange portions formed to extend from opposite sides of an opening edge of the cover, the pair of flange portions are located to overlap with the raised portion of the bottom plate turned over, and overlapping portions of one of the pair of flange portions and the raised portion are joined to each other by caulking the overlapping portions.

* * * * *